United States Patent [19]

Ramsey

[11] 4,258,595

[45] Mar. 31, 1981

[54] HIGH TORQUE SECTIONAL SOCKET RATCHET WRENCH

[76] Inventor: Marvin L. Ramsey, 213 Mounts, Apt. 3, Denton, Tex. 76201

[21] Appl. No.: 106,558

[22] Filed: Dec. 26, 1979

[51] Int. Cl.[3] ..... B25B 13/46

[52] U.S. Cl. ..... 81/61

[58] Field of Search ..... 81/60, 61, 62, 63, 63.1, 81/63.2

[56] References Cited

U.S. PATENT DOCUMENTS

| | | | |
|---|---|---|---|
| 1,153,694 | 9/1915 | Knox . | |
| 1,168,480 | 1/1916 | Collier . | |
| 1,314,964 | 9/1919 | Kennedy . | |
| 2,445,969 | 7/1948 | Powell | 81/63.2 |
| 2,446,776 | 8/1948 | Matson . | |
| 2,757,564 | 8/1956 | Reaves . | |
| 2,758,493 | 8/1956 | Goldwater . | |
| 2,982,162 | 5/1961 | Golden . | |
| 4,123,953 | 11/1978 | Corbacho . | |
| 4,130,032 | 12/1978 | Giandomenico et al. . | |

*Primary Examiner*—James L. Jones, Jr.

[57] ABSTRACT

A ratchet wrench usable where limited access normally requires an open end wrench, but which has the high torque capacity of a closed end socket wrench is disclosed. A pair of semicircular socket holders are releasably coupled to each other by a straight ratchet bar assembly for movement from a fully retracted, closed position to an extended, open position. A curved, semiconductor bore is formed transversely through each socket holder, with a recessed counterbore forming a semicircular guide chanel in each holder concentric with the transverse bore. First and second socket segments are received in rotational engagement with the guide channels of the first and second socket holders, respectively. Each socket segment includes a curved head having lands which in combination define a polygonal wrench opening. A curved ratchet carried by each socket segment is received in overlapping engagement with an exterior planar face of each socket holder. A pawl mechanism mounted on at least one of the socket holders is resiliently biased into engagement with the teeth of the curved ratchet, thereby allowing it to turn in one direction only, and preventing rotation of the ratchet in the opposite direction.

3 Claims, 4 Drawing Figures

HIGH TORQUE SECTIONAL SOCKET RATCHET WRENCH

BACKGROUND OF THE INVENTION

1. Field of the Invention

The invention relates generally to ratchet wrench construction, and more specifically to improvements to ratchet wrenches of the sectional socket type which are usable where limited access normally requires an open ended wrench.

2. Description of the Prior Art

There are a number of applications in which a closed end or socket wrench is preferred for use in making up or breaking a high torque union. One of the most common jobs in which this situation occurs is in the making and breaking of pipe union connections in which pipe sections extend both above and below the union, thereby making it impossible to use the standard box end wrench or socket. Additionally, there are a number of jobs in which such pipe unions are disposed in relatively inaccessible locations, which limit the stroke range of back-and-forth manipulations required for making up or breaking the coupling or union. This situation is commonly encountered in domestic plumbing installations. In such installations, it is not uncommon to find a pipe coupling which is frozen in place and which requires the application of high torque to break the coupling loose. Because of the high torque requirements of such a situation, it would be desirable to apply the breaking torque through a closed end box wrench, and because of the limited access typically found in such installations, it would also be desirable to apply the torque through a ratchet assembly.

SUMMARY OF OBJECTS OF THE INVENTION

It is, therefore, the principal object of the present invention to provide a ratchet wrench having a sectional socket head which can be opened and closed to permit the wrench to be slipped over a pipe or other elongated structure and moved therealong into torque transmitting engagement with the wrench lands of a coupling or other connector, and thereafter operated as a closed box ratchet wrench for making up or breaking the coupling or union.

A related object of the invention is to provide a sectional socket ratchet wrench having an improved coupling permitting rapid extension and retraction of the ratchet sections relative to each other.

Yet another object of the invention is to provide a high strength sectional socket assembly for use in a ratchet wrench.

Yet another object of the invention is to provide a ratchet wrench having a sectional socket, the component parts of which are readily removable and interchangeable with other sectional socket components to permit the wrench to be used in combination with couplings or unions of a variety of standard drive head configurations.

The invention further comprehends a novel ratchet bar/pawl mechanism for releasably coupling sectional sockets of a ratchet wrench.

SUMMARY OF THE INVENTION

The foregoing and other objects are accomplished in the present invention by a ratchet wrench assembly in which a pair of socket segments are rotatably journalled within first and second socket holders. The socket holders are releasably coupled to each other by a straight ratchet bar assembly for movement from a fully retracted, closed position to an extended, open position. Each socket segment includes a curved head coupled in rotational engagement with the socket holders. Each curved head includes wrench lands which in combination define a polygonal opening. Curved ratchets are carried by each socket segment in overlapping engagement with a planar face of each socket holder. A pawl mechanism is resiliently biased in engagement with the curved ratchet thereby allowing it to turn in one direction only, and preventing rotation of the ratchet in the opposite direction.

According to a preferred embodiment, each socket holder includes a recessed inner edge defining a curved guide channel, and each socket segment includes a curved rib which is journalled for rotation in the guide channel. Additionally, each socket holder includes a planar face which borders its curved opening, and the curved ratchet carried on each socket segment is received in overlapping engagement with the planar face. This arrangement produces an interleaved engagement of each socket segment with the socket holder, thereby stabilizing the assembly during use, and permitting easy removal and replacement of the socket segments.

The novel features which characterize the invention are defined by the appended claims. The foregoing and other objects, advantages and features of the invention will hereinafter appear, and for purposes of illustration of the invention, but not of limitation, an exemplary embodiment of the invention is shown in the appended drawing.

DETAILED DESCRIPTION OF THE PREFERRED EMBODIMENTS

Figure 1:
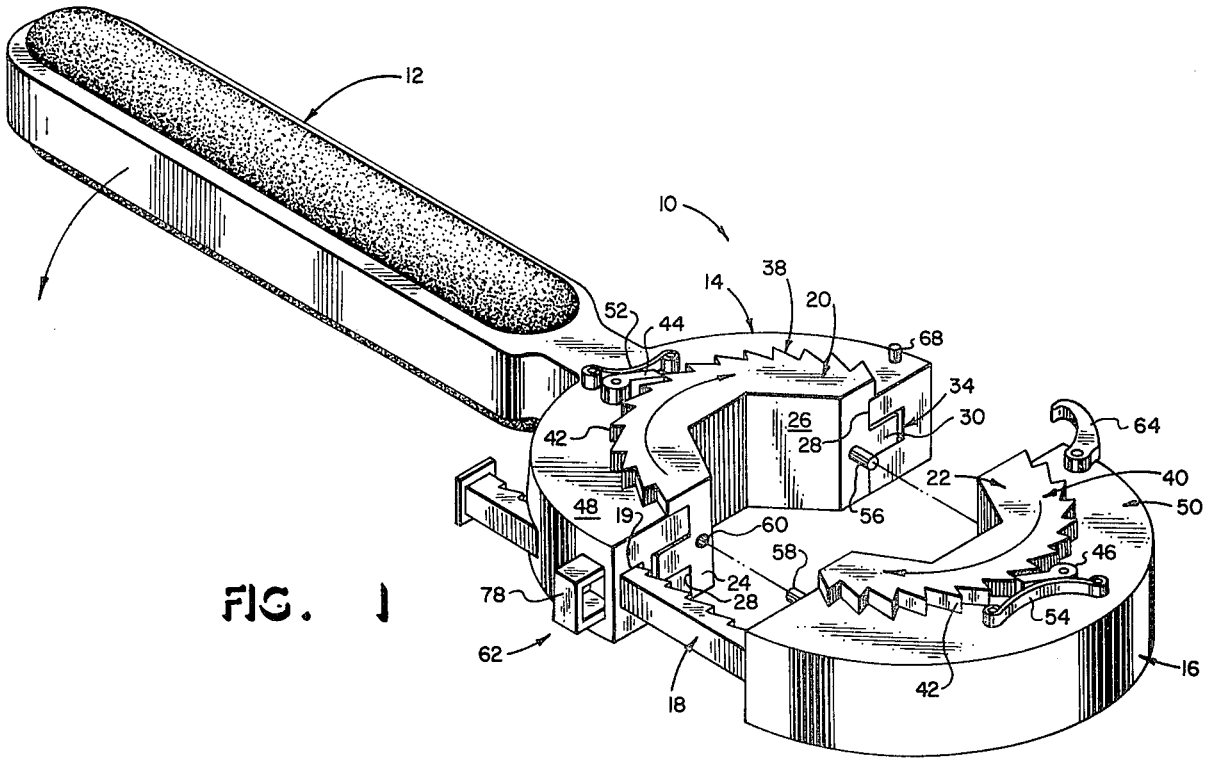
FIG. 1 is a perspective view of a sectional socket ratchet wrench constructed according to the teachings of the invention.

In the description which follows, like parts are marked throughout the specification and drawing with the same reference numerals, respectively. The drawings are not necessarily to scale and in some instances portions have been exaggerated in order to more clearly depict certain features of the invention.

Referring now to FIG. 1, a sectional socket wrench assembly constructed according to the teachings of the invention is identified generally by the reference numeral 10. The principal components of the ratchet wrench assembly include an elongated handle or lever arm 12 which is connected at one end by a socket holder 14. Releasably coupled to the socket holder 14 is a second socket holder 16. The socket holders are releasably coupled for extension and retraction between closed and opened positions relative to each other by a straight ratchet bar 18. One end of the ratchet bar 18 projects through a rectangular slide opening 19 formed through the socket holder 14, and the opposite end is rigidly secured to the socket holder 16. Received in rotational coupling engagement with each socket holder are identical socket segments 20, 22.

Figure 2:
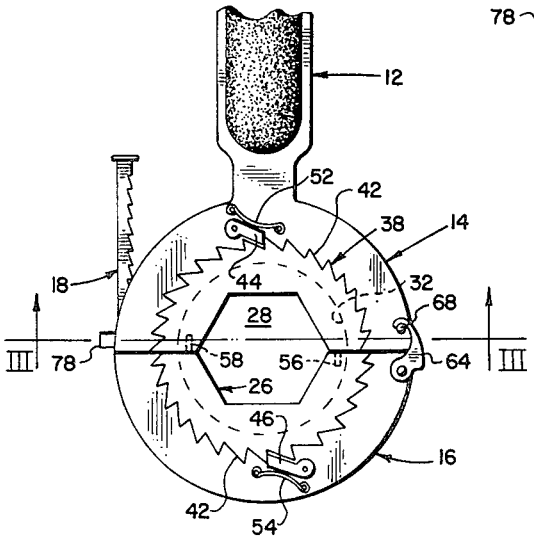
FIG. 2 is a top plan view of the ratchet wrench shown in FIG. 1.

Each socket segment includes a curved head 24 having interior wrench land surfaces 26 which in combination define a polygonal opening 28 (FIG. 2). Additionally, each socket includes a curved outer surface 28 from which a semicircular rib 30 projects.

Each socket holder is provided with a curved bore 32 which is intersected by a counterbore 34 having a recessed inner sidewall 36 defining a curved guide channel. The curved rib 30 of each socket segment is journalled for rotation in the guide channel 34. Each guide channel and rib are preferably rectangular in cross-section and extend along a semicircular path.

Secured to each socket segment is a curved ratchet 38, 40 which in combination define a continuous ratchet wheel, as can best be seen in FIG. 2. Each curved ratchet includes a series of teeth 42 for engaging a pawl 44, 46 carried on each socket holder, respectively.

According to an important feature of the invention, the socket holders 14, 16 are provided with planar surfaces 48, 50 which are disposed in slidable, surface engagement with the curved ratchets 38, 40, respectively. This overlapping engagement of the curved ratchets with the planar surfaces and the journalled engagement of the ribs in the guide channels 34 produce an interleaved engagement of each socket and socket holder. This results in a stable structure having a high torque transmitting capacity. Additionally, this interleaved arrangement makes possible the rapid removal and replacement of socket segments whereby the wrench can be adapted for use with a variety of standard coupling diameters and land configurations.

Referring now to FIGS. 1 and 2, the pawls 44, 46 are resiliently biased into engagement with the teeth 42 of each ratchet by leaf springs 52, 54. Although only one pawl is required for arresting motion of the combined ratchets, preferably at least two pawls, as illustrated, are provided to increase the torque capacity of the assembly. Each pawl 44, 46 is pivotally mounted on a pin, and each leaf spring is anchored in place by pins.

During operation, the combined curved ratchets rotate within the annular pathway provided by the two guide channels 34. The curved ratchets are further stabilized by a pair of pins 56, 58 which are insertable into an alignment bore 60 formed within each socket head 24 (FIG. 1).

The socket holders 14, 16 are coupled together by the ratchet bar 18 for movement from a closed position as shown in FIG. 2 to an open position as shown in FIG. 1. The socket holders are maintained in the closed position by a pawl mechanism 62 coupled to the ratchet bar 18, and by a pair of latches 64, 66. Each latch engages a pin 68, 70, respectively, in the closed position as shown in FIGS. 2 and 3.

Figure 3:
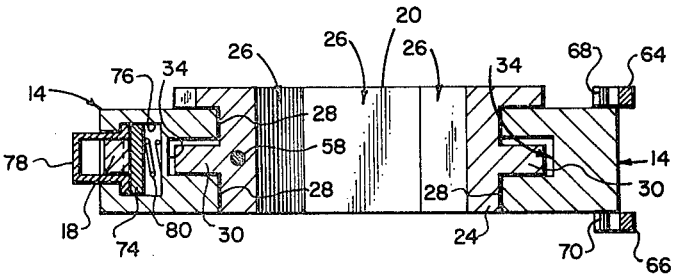
FIG. 3 is a sectional view taken along the lines III—III of FIG. 2; and, FIG. 4 is a perspective view, partly in section, of a portion of the wrench shown in FIG. 1.
Figure 4:
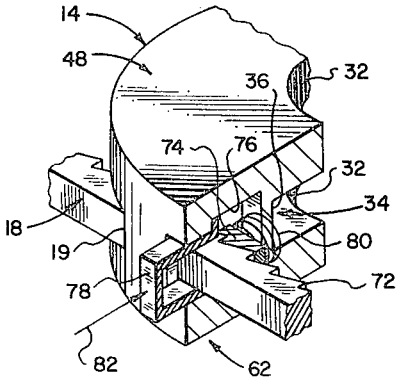

Referring now to FIGS. 3 and 4, the straight ratchet bar 18 includes teeth 72 which are engaged by a pawl 74 which is confined within a plunger chamber 76. The ratchet release mechanism 62 includes a plunger 78 and a compression spring 80 disposed on opposite sides of the pawl 74, respectively. The compression spring 80 resiliently biases the pawl 74 into interlocking engagement with the teeth 72 of the straight ratchet bar 18. Upon depression of the plunger 78 in the direction indicated by the arrow 82, the pawl 74 is displaced through the plunger chamber 76 out of engagement with the ratchet teeth 72, thereby allowing the ratchet bar to be displaced through the slide opening of the socket holder 14. Upon release of the plunger 78, the pawl 74 is driven back into interlocking engagement with the ratchet bar, thereby locking the socket holders together.

From the foregoing description of a preferred embodiment of the invention, those skilled in the art will appreciate that the slide ratchet wrench of the present invention provides a high torque capacity sectional ratchet assembly which may be quickly and easily utilized in job situations requiring a ratchet or a closed box end wrench, and in limited access situations. The provision of the interleaved socket and socket holder combination strengthens and stabilizes the wrench structure. Additionally, this interleaved arrangement permits the socket segments to be interchanged according to job requirements.

Although a preferred embodiment of the invention has been described in detail, it should be understood that various changes, substitutions and alterations can be made therein without departing from the spirit and scope of the invention as defined by the appended claims.

What is claimed is:

1. A wrench usable where limited access normally requires an open end wrench, but having the high torque capacity of a closed end, or socket wrench, comprising:

an elongated handle;

a first socket holder formed on one end of said handle, said first socket holder having a curved opening;

a second socket holder having a curved opening;

a straight ratchet bar releasably coupling the first and second socket holders for extension and retraction between closed and open positions relative to each other;

first and second socket segments each having a curved head coupled in rotational engagement with the curved opening of the first and second socket holders, respectively, and each curved head having interior wrench land surfaces which in combination define a polygonal opening;

a curved ratchet carried by at least one of said socket segments; and, a pawl mechanism mounted on one of said socket holders and resiliently biased in engagement with said curved ratchet allowing it to turn in one direction only, and preventing rotation of said ratchet in the opposite direction.

2. The wrench as defined in claim 1, each socket holder including a recessed inner sidewall defining a curved guide channel, and each socket segment having a curved rib journalled for rotation in said guide channel.

3. The wrench assembly as defined in claim 1, each socket holder having a planar face which borders its curved opening, and said curved ratchet being received in overlapping engagement with said planar face.

* * * * *